US005303984A

United States Patent [19]

Ojanen

[11] Patent Number: 5,303,984

[45] Date of Patent: Apr. 19, 1994

[54] CUTTING BIT HOLDER SLEEVE WITH RETAINING FLANGE

[75] Inventor: Randall W. Ojanen, Bristol, Tenn.

[73] Assignee: Valenite Inc., Troy, Mich.

[21] Appl. No.: 7,692

[22] Filed: Jan. 22, 1993

Related U.S. Application Data

[63] Continuation-in-part of Ser. No. 976,741, Nov. 16, 1992.

[51] Int. Cl.[5] ..... F21C 35/18

[52] U.S. Cl. ..... 299/86; 299/92

[58] Field of Search ..... 299/79, 86, 91, 92, 299/93

[56] References Cited

U.S. PATENT DOCUMENTS

| | | | |
|---|---|---|---|
| 3,749,449 | 7/1973 | Krekler | 299/93 |
| 3,865,437 | 2/1975 | Crosby | 299/86 |
| 4,084,856 | 4/1978 | Emmerich et al. | 299/86 |
| 4,201,421 | 5/1980 | Den Besten et al. | 299/86 |
| 4,217,150 | 1/1981 | Wrulich et al. | 299/86 |
| 4,333,687 | 6/1982 | Barnstort | 299/86 X |
| 4,836,614 | 6/1989 | Ojanen | 299/86 |
| 5,058,797 | 2/1992 | O'Neill | 299/91 |
| 5,098,167 | 3/1992 | Latham | 299/86 |

FOREIGN PATENT DOCUMENTS

| | | | |
|---|---|---|---|
| 1086153 | 4/1984 | U.S.S.R. | 299/92 |
| 1461907 | 2/1989 | U.S.S.R. | 299/86 |

*Primary Examiner*—David J. Bagnell

*Attorney, Agent, or Firm*—Bill C. Panagos

[57] ABSTRACT

A bit holder for a cutting tool utilizes a non-rotatable sleeve which is slit its entire length axially and is force-fitted into the bore of the bit holder. The sleeve is removable in the field and provides protection for the bit holder. In an alternate embodiment the sleeve is provided with additional retaining means in the form of a circumferential flange which extends beyond the bit holder and contacts the rearmost portion thereof.

3 Claims, 2 Drawing Sheets

CUTTING BIT HOLDER SLEEVE WITH RETAINING FLANGE

CROSS-REFERENCE TO RELATED APPLICATION

This application is a continuation-in-part of Ser. No. 07/976,741, filed Nov. 16, 1992.

TECHNICAL FIELD

This invention relates to bit holders for cutting tools and more particularly to a nonrotatable sleeve for use with such bit holders.

BACKGROUND ART

In the mounting of cutting tools via bit holders, which bit holders may be mounted on drums for rotation (see, for example, U.S. Pat. No. 3,749,449) it is occasionally desirable to mount the cutting bit through the intermediary of a sleeve, which can be a different material from the bit holder and more able to sustain the cutting environment without damage. Further, depending upon the application, it may be desirable to mount the sleeve so that it is rotatable about its longitudinal axis or to so mount it so that it is non-rotatable. In the case of non-rotatable mounting it is generally appropriate to employ a sleeve which is friction-fitted into an appropriate aperture in the bit holder. When the sleeve is too tightly fitted, replacement in the field (which may be in a mine) becomes difficult. The prior art has addressed this problem in several ways. In U.S. Pat. No. 4,836,614 a device is described which protects the entire bit holder bore; however, it is not cost effective to manufacture since a separate sleeve must be attached to each tool. In U.S. Pat. No. 4,201,421 a split sleeve of spring steel or like material is employed; however, this sleeve must be inserted with the cutting bit and, likewise, removal of the cutting bit requires removal of the sleeve, whether it needs replacement or not. U.S. Pat. No. 5,088,797 provides a friction-fitted sleeve which has limited engagement with the internal surface of the bit holder bore to aid in removal. This sleeve requires considerable machining, both before and after heat treatment, to provide the 0.002" to 0.005" tolerances required to make it work well. This is an expensive consideration. U.S. Pat. No. 5,098,167 suggests the use of threaded sleeves to avoid rotation; however, this also adds to the cost and time of replacement. U.S. Pat. No. 4,247,150 provides for the use of an oil channel between the sleeve and the inner surface of the bit holder bore, with means for injecting oil under pressure to aid in removal. This solution also requires extra machining and added cost. U.S. Pat. Nos. 3,865,437 and 4,084,856 disclose rotatable tools or sleeves having a plurality of projections formed at one end to engage the rearmost portion of a tool holder. These tools are expensive to manufacture since the projections require special machining operations because they depart from true cylindricality.

DISCLOSURE OF THE INVENTION

It is, therefore, an object of this invention to obviate the disadvantages of the prior art.

It is another object of the invention to enhance friction-fitted sleeves for cutting bit holders.

Yet another object of the invention is the enhancement of non-rotatable tool sleeves for cutting bit holders.

These objects are accomplished, in one aspect of the invention, by the provision of a bit holder for rotatably mounting a cutting bit, wherein the cutting bit comprises an elongated member having a cutting element at one end thereof and a substantially cylindrical shank at the other end thereof. The bit holder comprises a body having an axial bore therein having at least one given diameter and a particular inside surface configuration. A non-rotatable, diametrically compressible sleeve is mounted in the axial bore prior to the insertion of the cutting bit. The sleeve has an outer surface configuration intimately matching the particular inside configuration and is in substantial engagement therewith over its entire length. The sleeve has a diameter larger than the given diameter before insertion into the axial bore and a compressed diameter substantially matching the given diameter after insertion into the axial bore. The sleeve is provided with an axial slot which runs its entire length. The slot has a width which decreases upon insertion into the axial bore and provides the compressed diameter. The rearward end of the sleeve is provided with retaining means in the form of a circumferential flange, continuous thereabout except for the slot. The flange has a diameter greater than the axial bore even after insertion. The flange thus serves to retain the sleeve in the bore. Because the flange is circumferential, it requires much less machining than sleeves having a plurality of projections thereon and is thus reproducible at less cost.

It will be seen that the use of the invention described herein provides tremendous additional improvement over those devices of the prior art. It is not limited to small areas of frictional contact; it does not have to be inserted and removed with the cutting bit, thus allowing for economical, selective replacement; it does not require additional threading operations; and its wide tolerance range eliminates additional machining steps.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
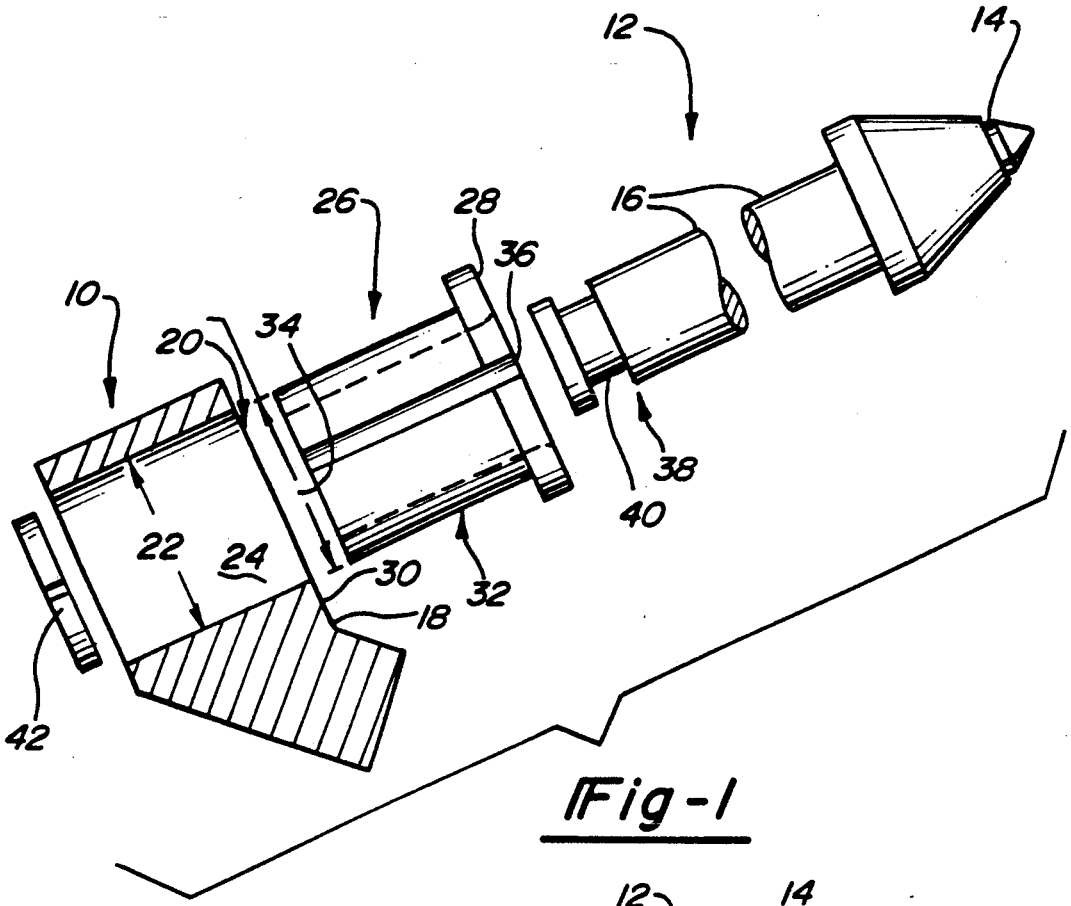
FIG. 1 is an exploded, perspective view of an embodiment of the invention.
Figure 2:
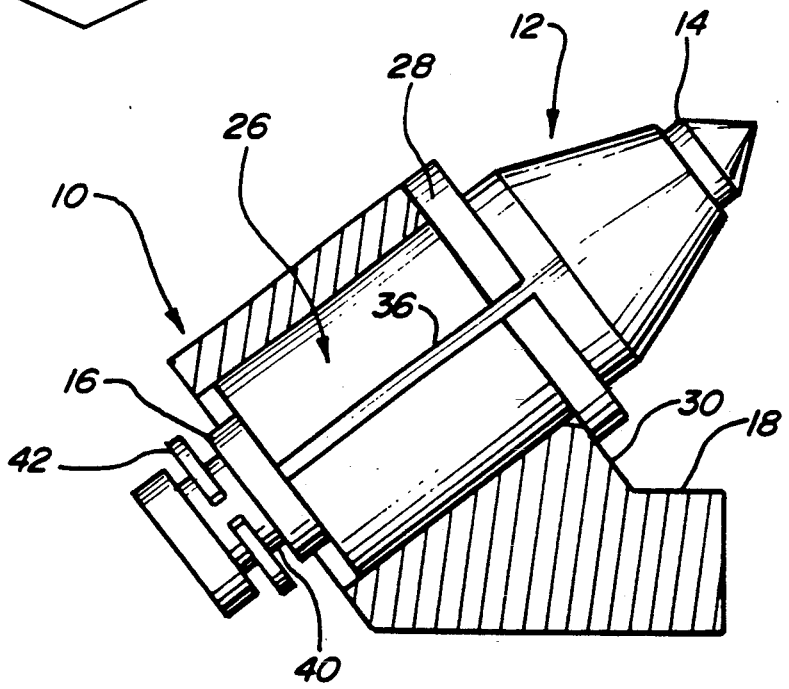
FIG. 2 is a sectional elevational view of an assembled embodiment of the invention.
Figure 3:
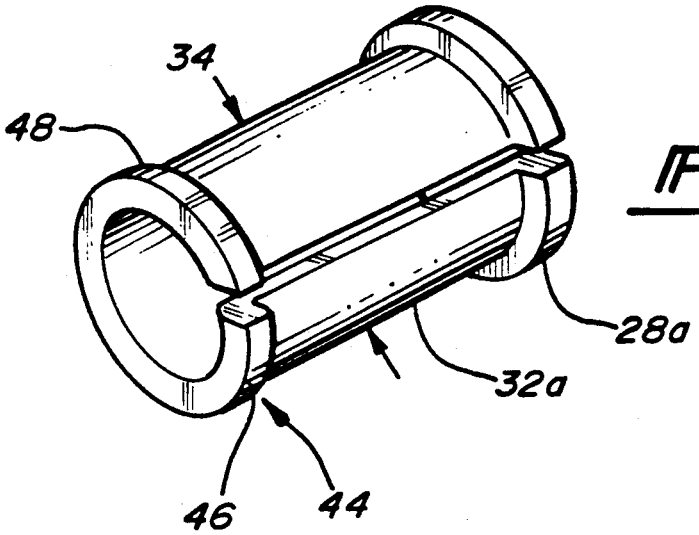
FIG. 3 is a perspective view of an alternate sleeve.

Referring now to the drawings with greater particularity, there is shown in FIG. 1 a bit holder 10 for rotatably mounting a cutting bit 12. The cutting bit 12 comprises an elongated member having a cutting element 14 at one end thereof and a substantially cylindrical shank 16 at the other end thereof The bit holder 10 comprises a body 18 having an axial bore 20 therein having at least one given diameter 22 and a particular inside surface configuration shown generally as 24. A non-rotatable, diametrically compressible sleeve 26 is mounted in axial bore 20 prior to the insertion of cutting bit 12. A collar 28 at one end of sleeve 26 has a diameter much larger than the given diameter 22 whereby the collar engages a face 30 of the body 10 and limits the axial penetration of sleeve 26 into axial bore 20. The sleeve 26 has an outer surface configuration 32 intimately matching the particular inside configuration 24 which is present in bore 20 and substantially in engagement therewith over its length. See FIG. 2. The sleeve 26 has a diameter 34 larger than given diameter 22 before insertion into axial bore 20 and a compressed diameter substantially matching given diameter 22 after insertion into axial bore 20. The sleeve 26 is provided with an axial slot 36 which runs its entire length. The slot 36 has a width which decreases upon insertion into the axial bore 20 and provides the compressed diameter.

The terminal end 38 of shank 16 is provided with a groove 40 for receiving a retaining ring 42, which can be a "C" ring.

In a preferred embodiment of the invention, sleeve 26 can have a thickness of between 0.092 and 0.100 and slot 36, in the uncompressed mode, occupies about 4% of the circumference of sleeve 26. Thus, where sleeve 26 has a nominal diameter of about 1", slot 36 will have a width of 0.125" when it is uncompressed.

When the bit holder axial bore 20 has a given diameter of between 0.975" and 0.985" the sleeve 26 can have a diameter of between 0.990" and 1.00", which is 0.005" to 0.025" larger than the bore 20. Tolerances of this magnitude require machining only prior to heat treating. Because the sleeve is manufactured from substantial material, a hammer can be used to drive it into the bore and the rotatable cutting bit can be subsequently installed and fixed in place by the ring 42.

Even though the sleeve 26 makes intimate contact with substantially the entire inside surface of the bore 20, its compressibility provides for relatively easy removal when necessary.

Figure 4:
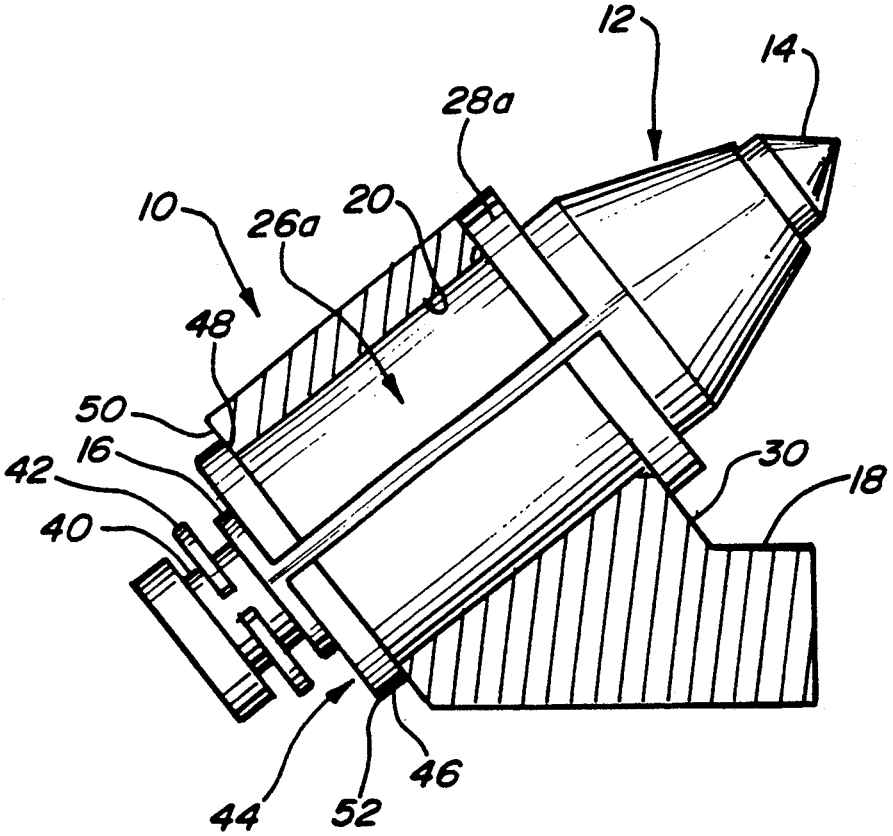
FIG. 4 is an elevational view, partly in section, of the sleeve of FIG. 3 assembled with a bit holder.

Referring now to FIG. 4, an alternate embodiment is shown. Therein is shown a bit holder 10 for rotatably mounting a cutting bit 12 which can be the same as that shown with reference to FIG. 1. A non-rotatable, diametrically compressible sleeve 26*a* is mounted in axial bore 20 prior to the insertion of cutting bit 12. A collar 28*a* atone end of sleeve 26*a* has a diameter much larger than the given diameter 22 whereby the collar engages a face 30 of the body 10 and limits the axial penetration of sleeve 26 into axial bore 20. The sleeve 26*a* has an outer surface configuration 32*a* intimately matching the particular inside configuration 24 which is present in bore 20 and substantially in engagement therewith over its length. See FIG. 4. The sleeve 26*a* has a diameter 34*a* larger than given diameter 22 before insertion into axial bore 20 and a compressed diameter substantially matching given diameter 22 after insertion into axial bore 20. The sleeve 26*a* is provided with an axial slot 36*a* which runs its entire length. The slot 36*a* has a width which decreases upon insertion into the axial bore 20 and provides the compressed diameter.

The rearward end of sleeve 26*a*, i.e., the end of sleeve 26*a* remote from collar 28*a* is provided with additional sleeve retaining means 44 in the form of a circumferential flange 46, continuous thereabout except for the slot 36*a*. In a preferred embodiment, the diameter of the flange 46 is about between 1 to about 2.5% of the diameter 34*a*. The upper surface 48 of flange 46 abuts the rearmost surface 50 of bit holder 10. To aid in insertion of sleeve 26*a* into the axial bore 24, a chamfer 52 can be provided on what will be the leading edge of the retaining means 44.

The improvements provided by the circumferential flange include ease of manufacture with its consequent economies, together with greater holding power and less damage to the bit holder 10 during use since the greater area of contact minimizes chipping of the rearmost surface 50. The above-mentioned holding power has been shown to increase from about 500 to 600 pounds to about 1000 to 1200 pounds, a factor of 2, upon employment of the retaining flange.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A bit holder for rotatably mounting a cutting bit, said cutting bit comprising: an elongated member having a cutting element at one end thereof and a substantially cylindrical shank at the other end thereof; said bit holder comprising a body having an axial bore therein having at least one given diameter and a particular inside surface configuration; and a non-rotatable, diametrically compressible sleeve mounted in said axial bore, said sleeve being mounted prior to the insertion of said cutting bit, a collar at one end thereof having a diameter much larger than said given diameter whereby said collar engages a face of said body and limits the axial penetration of said sleeve into said axial bore, and additional retaining means formed at an opposite end, said retaining means extending beyond said bore, said sleeve having an outer surface configuration intimately matching said particular inside configuration and substantially in engagement therewith over its length, said sleeve having a diameter larger than said given diameter before insertion into said axial bore and a compressed diameter substantially matching said given diameter after insertion into said axial bore, said sleeve being provided with an axial slot which runs its entire length, said slot having a width which decreases upon insertion into said axial bore and provides said compressed diameter.

2. The bit holder of claim 1 wherein said retaining means comprises a circumferential flange, continuous about said given diameter, except for said slot.

3. The bit holder of claim 2 wherein said flange has a diameter about between 1 and 2.5% of said given diameter.

* * * * *